US006393618B2

(12) United States Patent
Garneau

(10) Patent No.: US 6,393,618 B2
(45) Date of Patent: May 28, 2002

(54) SEAT PAD FOR CYCLIST PANT, AND PROCESS OF MANUFACTURE THEREOF

(76) Inventor: Louis Garneau, 246 Chemin de la Butte, St-Augustin-de-Desmaures, Quebec (CA), G3A 1W7

( * ) Notice: Subject to any disclaimer, the term of this patent is extended or adjusted under 35 U.S.C. 154(b) by 0 days.

(21) Appl. No.: 09/875,896

(22) Filed: Jun. 8, 2001

Related U.S. Application Data

(60) Provisional application No. 60/211,278, filed on Jun. 13, 2000.

(51) Int. Cl.[7] ..... A41D 1/06
(52) U.S. Cl. ..... 2/228; 2/227; 2/214
(58) Field of Search ..... 2/228, 214–215, 2/238, 79, 243.1, 53, 267, 400, 401, 82, 227

(56) References Cited

U.S. PATENT DOCUMENTS 4,333,465 A 6/1982 Wiegner
D288,363 S 2/1987 Wallstrom
4,662,876 A 5/1987 Wiegner
4,961,233 A 10/1990 Black
5,068,920 A * 12/1991 Bray ..... 2/455
5,271,101 A 12/1993 Speth et al.
D360,971 S 8/1995 Speth et al.

* cited by examiner

*Primary Examiner*—John J. Calvert
*Assistant Examiner*—Tajash Patel

(57) ABSTRACT

A flexible seat pad for fitting onto the inside crotch portion of a cyclist, the seat pad consisting of a generally convex unitary flexible sheet member, the sheet member defining: a number of pad bulges, integral to the sheet member, the pad bulges being resiliently compressible; and hinge lines, hingedly interconnecting adjacent pairs of pad bulges. The hinge lines assist in enabling said flexible sheet member to conformingly fit onto the inside crotch portion of the cyclist for dynamic comfort of the cyclist during pedalling.

16 Claims, 6 Drawing Sheets

SEAT PAD FOR CYCLIST PANT, AND PROCESS OF MANUFACTURE THEREOF

This application claims the benefit of U.S. Provisional Application No. 60/211,278 filed on Jun. 13, 2000.

FIELD OF THE INVENTION

This invention relates to seat pads for shorts, in particular for cyclists shorts.

BACKGROUND OF THE INVENTION

Bicycling has several advantages over other means of transport. It is very efficient, it is good for the cardiovascular health of the person practicing this sport, it is environmentally friendly since no toxic wastes are generated per se, it is lightweight, it takes little storage space when not in use, it is easy to handle through heavy road traffic, it can access narrow roads not accessible by larger vehicles, etc. Governments in developed and developing countries promote its use.

Among its disadvantages, there are the safety considerations from road hazards, the absence of adverse weather shielding, and physical strain associated with long duration trips. In particular, there is a problem of comfort linked to the seat, and also a possible health hazard connected to the load biases applied by the seat to the genital parts of the cyclist. For example, in man, possibly damaging compressive forces whose direction, frequency and magnitude are often unpredictable are applied by the seat directly to the scrotum and indirectly to the prostate. In woman, possible damaging shearing or shaffing forces are applied by the seat to the vulva labiae.

The present invention is therefore directed at addressing the issues raised by the bodily injuries that can be sustained as a consequence of riding on a bicycle seat, by providing an ergonomically designed seat pad destined to fit against and be stitched to the inside crotch portion of a cyclist pant.

SUMMARY OF THE INVENTION

The invention relates to a flexible seat pad for mounting into the inside crotch portion of a cyclist pant, said seat pad comprising: a) a thick intermediate layer made from resiliently compressible material; b) a thin top layer made from a non-compressible sheet material; and c) a thin bottom layer made from a non-compressible sheet material; wherein said intermediate layer has a variable thickness and said seat pad is sized and shaped so as to conformingly fit against the inside crotch portion of a cyclist pant, for dynamic comfort of the cyclist during pedalling.

Said intermediate layer could consist of open cell foam, preferably polyurethane. Said top layer could consist of a synthetic material, preferably polyester, most preferably brushed micro-fiber polyester. Said bottom layer could consist of a soft synthetic material, preferably polyester felt.

Preferably, each of said top layer and bottom layer has between 0.5 to 1 mm thickness. Said seat pad could be subdivided into a number of pad bulges of variable thickness, each pair of adjacent said pad bulges being interconnected by a hinge line, said hinge line being formed by bringing directly together said top layer and said bottom layer and releasing said compressible material of the intermediate layer therebetween. Preferably, said pad bulges include an intermediate pad bulge and a front pad bulge each of intermediate thickness relative to the other pad bulges, a pair of rear pad bulges of largest thickness relative to the other pad bulges, a first pair of lateral side pad bulges and a second pair of lateral side pad bulges each of smallest thickness relative to the other pad bulges. Preferably, said intermediate pad bulge and said front pad bulge each has about 5 mm in thickness, said rear pad bulges each has about 10 mm in thickness, said first lateral side pad bulges each has about 3 mm in thickness, said second lateral side pad bulges each has about 4 mm in thickness, and each said hinge line has a thickness of between 1 to 2 mm.

Said seat pad could define a front portion and a rear end portion, said front portion being narrower than said rear end portion, said front portion defining a generally semi-cylindrical shape in front end view, said rear end portion being slightly arcuate and coextensive with said generally semi-cylindrical shape of said rear end portion.

Preferably, there is further included a number of air/moisture surface circulation channels, made onto said top layer, for promoting diffusion of cyclist transpiration moisture.

The invention also relates to a process of manufacture of a seat pad for mounting into the inside crotch portion of a cyclist pant, the seat pad of the type having a thick open cell foam intermediate layer, a thin micro-fiber polyester top layer, and a thin polyester felt bottom layer, said process comprising the following steps: a) molding the seat pad with an ultrasound gun, so as to shape the seat pad conformingly to the crotch portion of the cyclist pant; and b) permanently compressing selected areas of the seat pad intermediate layer by heat stamping, wherein thin hinge lines are formed by bringing together and merging the top and bottom layers of the seat pad and release of the open cell foam therebetween, these hinge lines delineating a number of variable-thickness seat pad bulges, said seat pad bulges sized to conformingly fit against corresponding portions of the crotch portion of the cyclist pant.

The invention also relates to a flexible seat pad for fitting onto the inside crotch portion of a cyclist, said seat pad consisting of a generally convex unitary flexible sheet member, said sheet member defining: a) a number of pad bulges, integral to said sheet member, said pad bulges being resiliently compressible; and b) hinge means, hingedly interconnecting adjacent pairs of said pad bulges, said hinge means assisting in enabling said flexible sheet member to conformingly fit onto the inside crotch portion of the cyclist for dynamic comfort of the cyclist during pedalling.

Accordingly then, each of said pad bulges could then include a core layer made of polyurethane, a first surface layer and a second surface layer opposite said first surface layer, both said first surface layer and second surface layer being made from polyester. Said first surface layer could be made from polyester felt, said polyester felt for engaging the thigh skin of the cyclist; and said second surface layer could be made from brushed micro-fiber polyester.

DETAILED DESCRIPTION OF THE EMBODIMENTS

Figure 1:
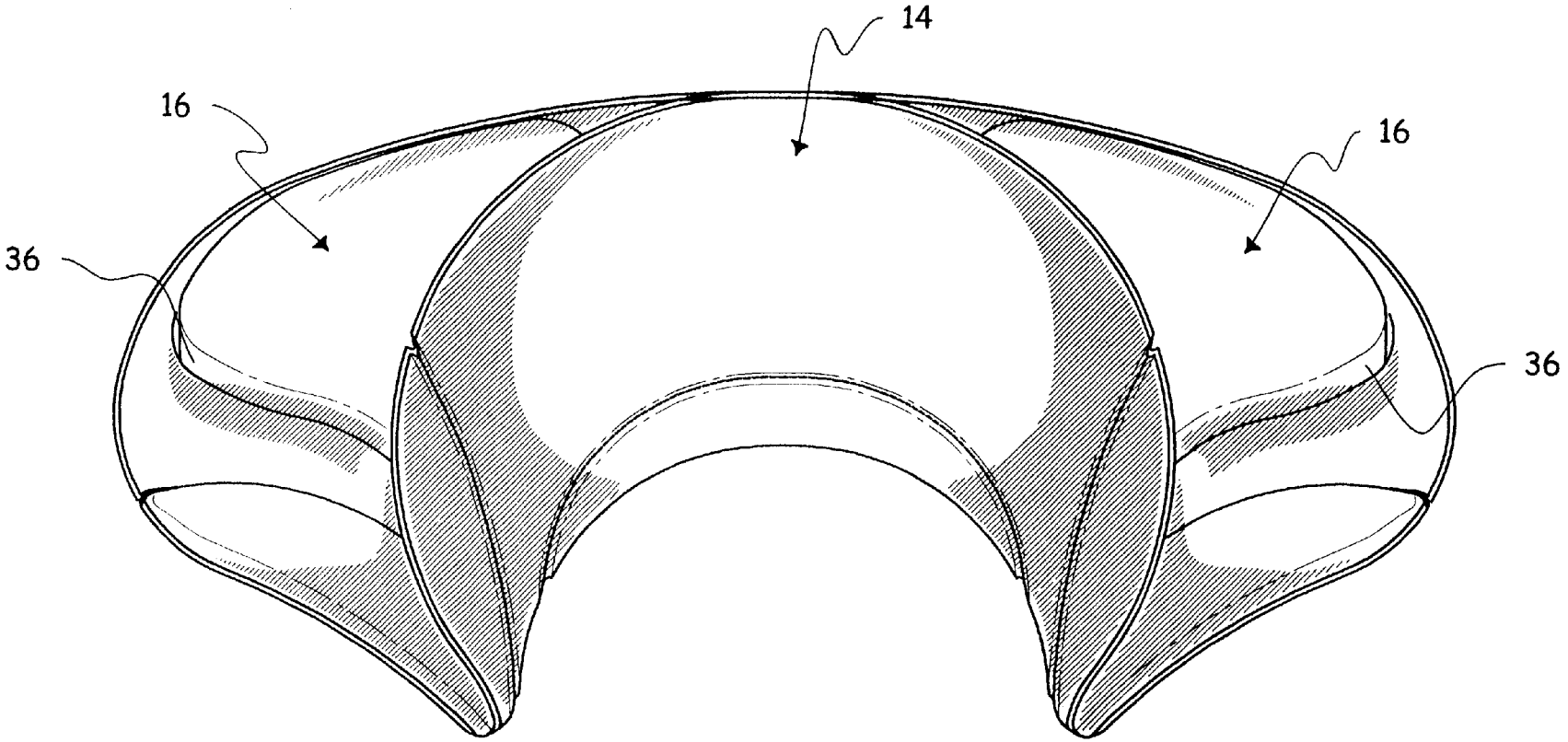
FIG. 1 is a front elevational view of the seat pad according to a preferred embodiment of the invention.
Figure 2:
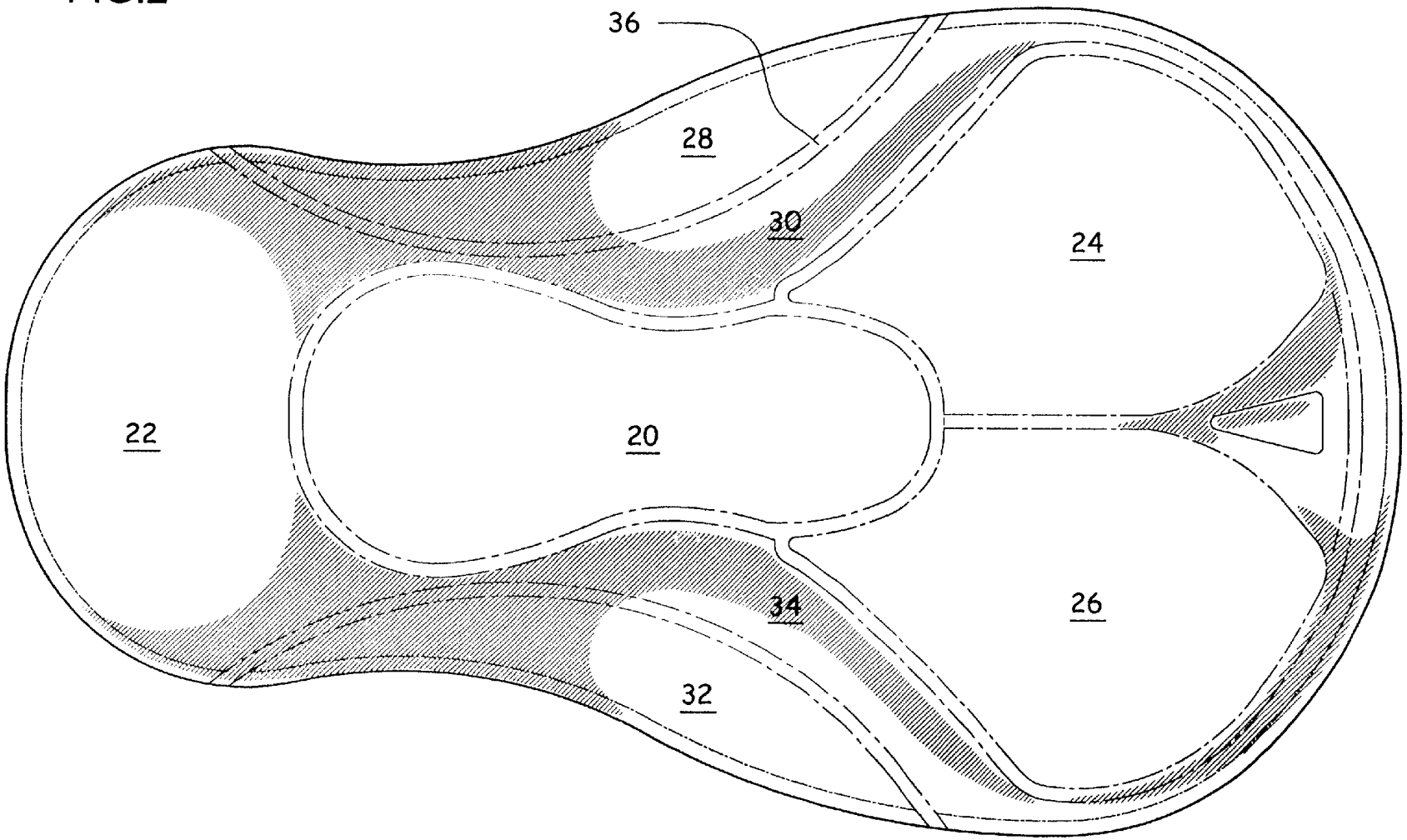
FIG. 2 is a top plan view of this seat pad.
Figure 3:
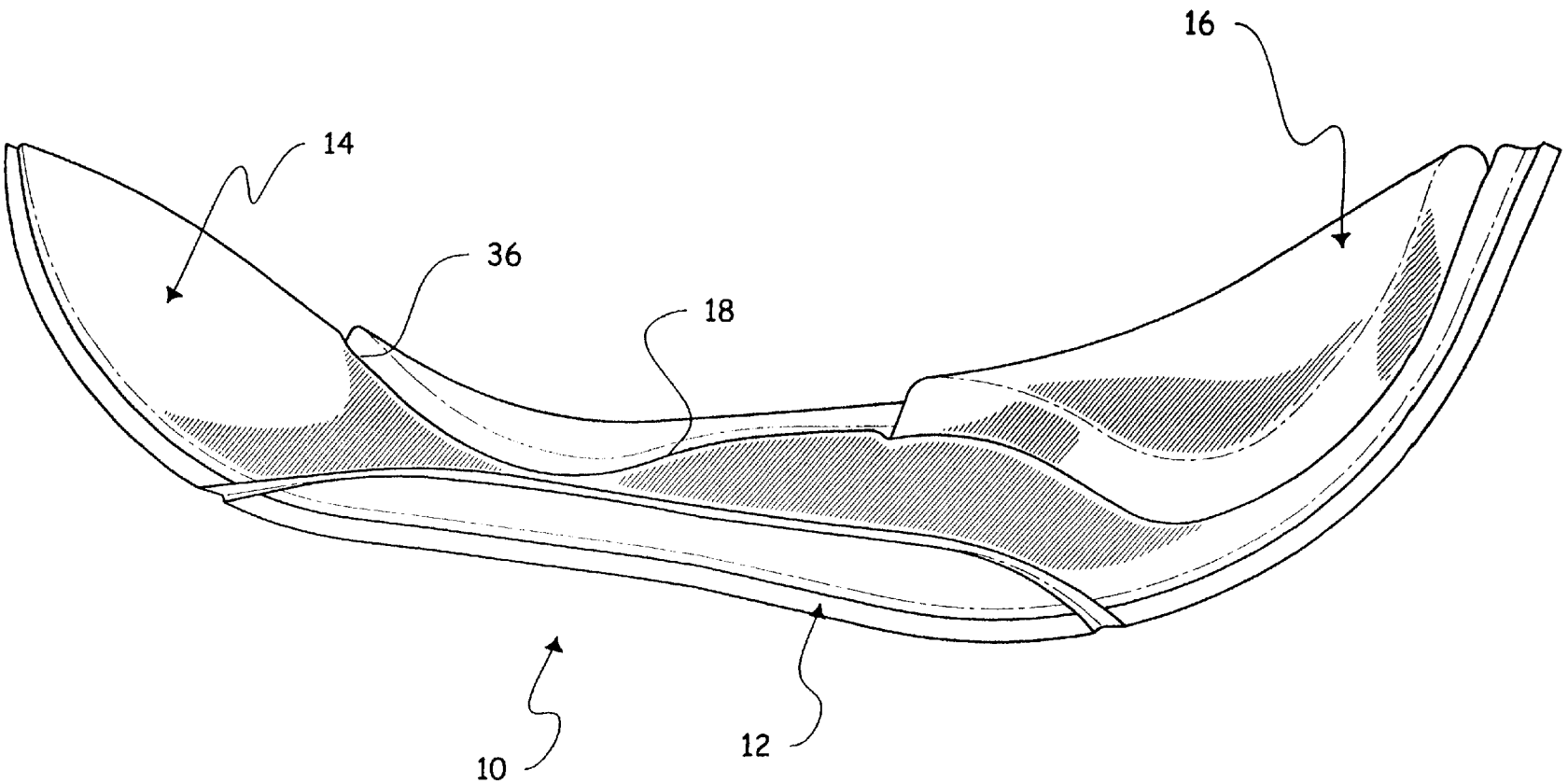
FIG. 3 is a lateral side edge view of this seat pad.

As shown in FIGS. 1–3 of the drawings, the seat pad 10 consists of a sheet member 12 being pretensioned into generally upwardly convex shape, with its front end portion 14 and its rear end portion 16 being raised relative to the intermediate section thereof 18.

As shown in FIG. 1, the front portion 14 is narrower than the rear end portion 16, and defines a generally semi-cylindrical shape in front end view.

Figure 4:
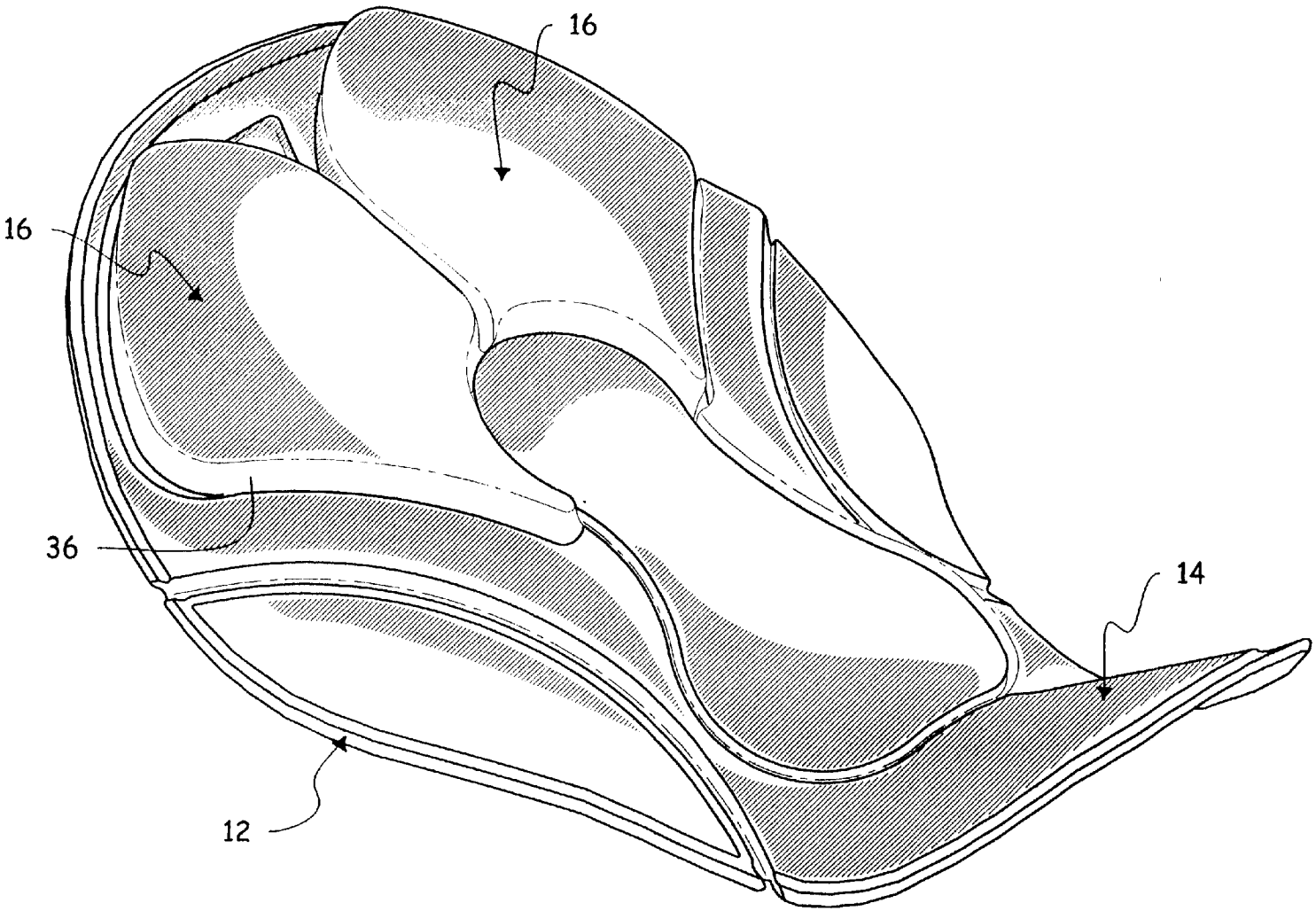
FIG. 4 is a perspective view of this seat pad.

As shown in FIGS. 2 and 4, the seat pad 10 includes eight different thick pad bulges 20, 22, 24, 26, 28, 30, 32 and 34, being separated from one another in adjacent pairs by thinned out hinge lines 36. The intermediate pad bulge 20 and the adjacent front pad bulge 22 each has a smaller overall thickness relative to the other pad bulges, preferably of about five millimeters (5 mm), whereas each of the two rear pad bulges 24, 26, adjacent the intermediate pad bulge 20 has a larger overall thickness relative to the other pad bulges, preferably of about 10 mm thickness. Along each of the two opposite lateral side edges of the intermediate pad bulge 20, there is found a pair of narrow but elongated side pad bulges 28, 30, and 32, 34. The edgewise side pad bulges 28 and 32 have the smallest overall thickness relative to the other pad bulges, preferably of about 3 mm thickness, while the inner side pad bulges 30, 34, adjacent to the intermediate pad bulge 20 also have a smallest overall thickness relative to the other pad bulges, but preferably slightly thicker than pad bulges 28 and 32. Preferably, intermediate pad bulge 20 has about 4 mm of thickness.

Figure 5:
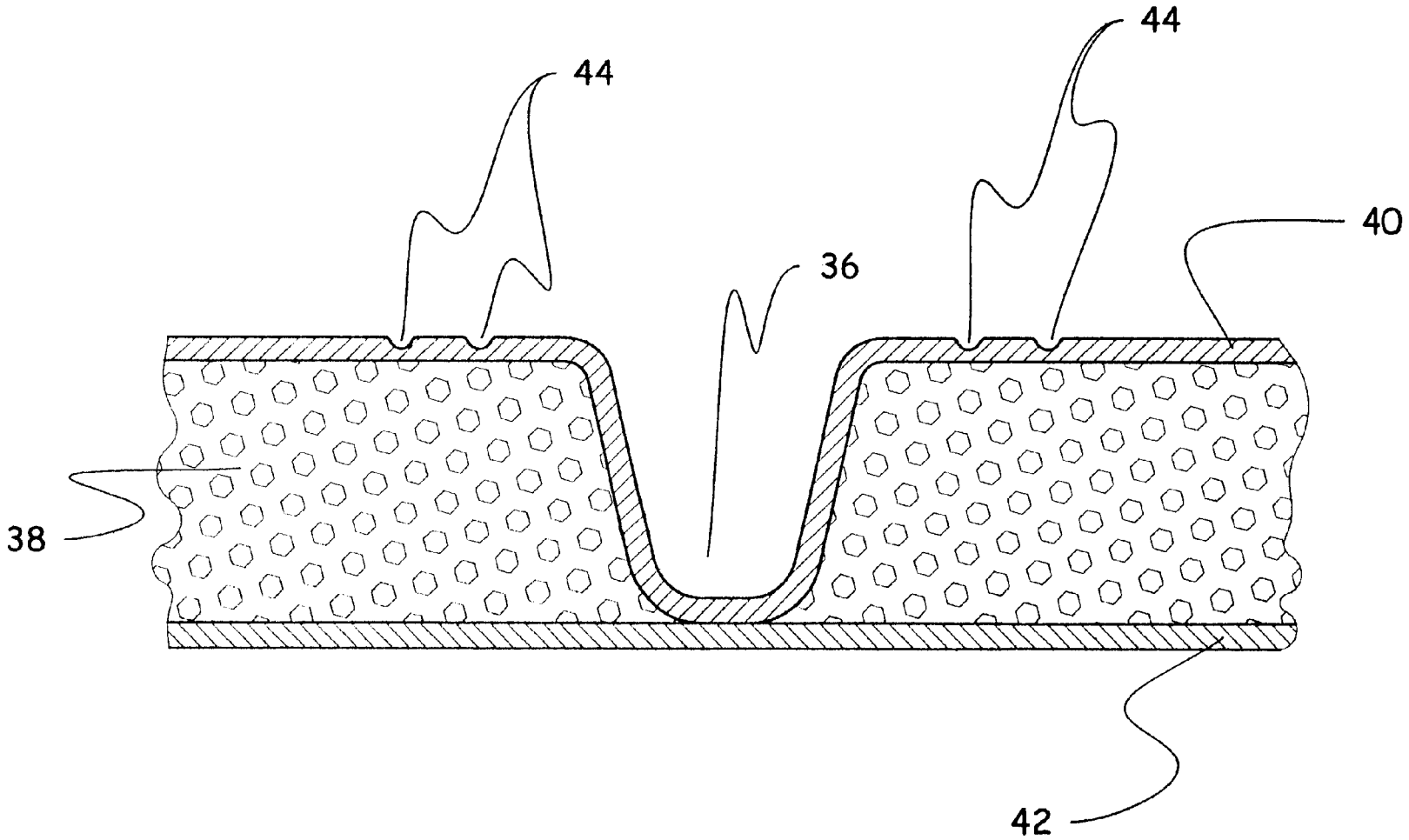
FIG. 5 is a cross-sectional view at an enlarged scale of a portion of this seat pad.

As illustrated in FIG. 5, the seat pad consists of three layers of material:

a) a thick yet compressible intermediate layer 38 of open cell foam, for example polyurethane or other "air breathing" foam material;

b) a thin top layer 40 made from a non-compressible sheet material, preferably a synthetic material such as polyester, most preferably brushed micro-fiber polyester; top layer has preferably between 0.5 to 1 mm thickness; and c) a thin bottom layer 42 made from a non-compressible sheet material, preferably a soft synthetic material, most preferably polyester felt; bottom layer 42 has preferably between 0.5 to 1 mm thickness.

Figure 6:
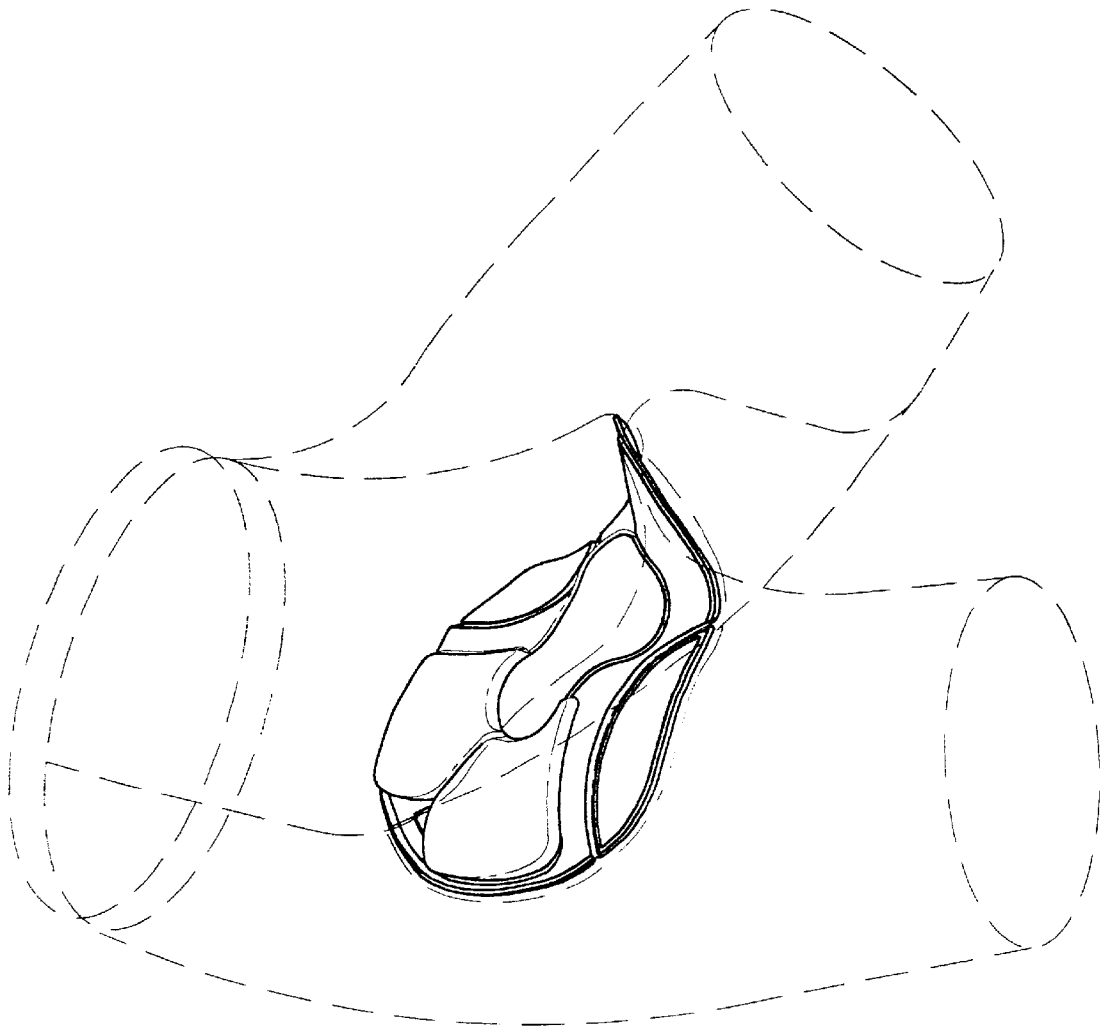
FIG. 6 is a perspective view of a cyclist pant shown in phantom lines, with the seat pad illustrated in full lines in its crotch position into this cyclist pant.

As illustrated in FIG. 6, the felt layer 42 of the seat pad 10 is preferably directly stitched flatly and conformingly to the crotch portion of the cyclist pant. However, the seat pad 10 could alternately be mounted in free floating fashion onto the crotch portion of the cyclist pant. This felt layer 42 is for example of the unweaved tufted type, or other soft material kind to the cyclist crotch skin.

As shown in FIG. 5, the micro-fiber polyester layer 40 includes shallow air and/or moisture circulation channels 44 that further promotes surface diffusion of air and bodily fluids transpiration. Channels 44 preferably have between 0.25 to 0.5 mm in depth, i.e. about half the thickness of the polyester layer 40. Each channel 44 may be cross-sectionally U-shape, as shown in FIG. 5, but a V-shape or other suitable trough shapes are not excluded from the scope of the present invention, provided this channel is able to convey fluids along the surface of the seat pad.

The hinge lines 36 are made by heat stamping and by compression. When the hinge lines 36 are formed, the open cell foam material is laterally released so that the top and bottom polyester layers 40, 42 become fused with one another, as shown in FIG. 5. Accordingly, no—or very little—open cell foam layer remains at the hinge lines 36 between the two opposite surface layers 40, 42. The hinge lines 36 will have for example a total thickness of about 1 to 2 mm.

The general molding process is preferably performed by an ultrasound gun. The results are such that the thick various pad bulges 20–34 are hinged to one another by the thin hinge lines 36, and these pad bulges are of varying overall thickness—as per varying permanent compression of the intermediate compressible open cell foam layer 38, to provide optimum comfort at the genital areas. This optimum comfort is brought about by the fact that, due to the modulated thickness of the seat pad sheet member 12, adjusted compressive forces are applied by the seat pad 10 to the crotch body parts of the cyclist, thus substantially reducing the discomfort to the genital areas by accommodating the thickness of the sheet member 12 to the corresponding adjacent anatomical topography of the person.

The pretensioned frontward and rearward flaring of the front and rear sheet portions 14 and 16 again provide snug anatomical conformation to the cyclist crotch portion, again enhancing overall comfort.

I claim:

1. A flexible seat pad for mounting into the inside crotch portion of a cyclist pant, said seat pad comprising:

a) a thick intermediate layer made from resiliently compressible material;

b) a thin top layer made from a non-compressible sheet material;

c) a thin bottom layer made from a non-compressible sheet material; and d) a number of air/moisture circulation channels made onto said top layer, for promoting diffusion of cyclist transpiration moisture;

wherein said intermediate layer has a variable thickness and said seat pad is sized and shaped so as to conformingly fit against the inside crotch portion of a cyclist pant, for dynamic comfort of the cyclist during pedalling.

2. A seat pad as in 1, wherein said intermediate layer consists of open cell foam.

3. A seat pad as in 2, wherein said intermediate layer consists of polyurethane.

4. A seat pad as in 1, wherein said top layer consists of a synthetic material.

5. A seat pad as in 4, wherein said top layer consists of polyester.

6. A seat pad as in 5, wherein said top layer consists of brushed micro-fiber polyester.

7. A seat pad as in 1, wherein said bottom layer consists of a soft synthetic material.

8. A seat pad as in 7, wherein said bottom layer consists of polyester felt.

9. A flexible seat pad for mounting into the inside crotch portion of a cyclist pant, said seat pad comprising:

a) a thick intermediate layer made from resiliently compressible material;

b) a thin top layer made from a non-compressible sheet material; and c) a thin bottom layer made from a non-compressible sheet material;

said intermediate layer having a variable thickness and said seat pad is sized and shaped so as to conformingly fit against the inside crotch portion of a cyclist pant, for dynamic comfort of the cyclist during pedalling;

each of said top layer and bottom layer having between 0.5 and 1 mm thickness;

said seat pad being subdivided into a number of pad bulges of variable thickness, each pair of adjacent said pad bulges being interconnected by a hinge line, said hinge line being formed by bringing directly together said top layer and said bottom layer and releasing said compressible materials of the intermediate layer therebetween;

wherein said pad bulges include an intermediate pad bulge and a front pad bulge each of intermediate thickness relative to the other pad bulges, a pair of rear pad bulges of largest thickness relative to the other pad bulges, a first pair of lateral side pad bulges and a second pair of lateral side pad bulges each of smallest thickness relative to the other pad bulges.

10. A seat pad as in 9, wherein said intermediate pad bulge and said front pad bulge each has about 5 mm in thickness, said rear pad bulges each has about 10 mm in thickness, said first lateral side pad bulges each has about 3 mm in thickness, said second lateral side pad bulges each has about 4 mm in thickness, and each said hinge line has a thickness of between 1 to 2 mm.

11. A seat pad as in 9, wherein said seat pad defines a front portion and a rear end portion, said front portion being narrower than said rear end portion, said front portion defining a generally semi-cylindrical shape in front end view, said rear end portion being slightly arcuate and coextensive with said generally semi-cylindrical shape of said rear end portion.

12. A flexible seat pad for fitting onto the inside crotch portion of a cyclist, said seat pad consisting of a generally convex unitary flexible sheet member, said sheet member being pretensioned into a saddle-like shape without utilizing stitching lines, said sheet number defining:

a) a number of pad bulges, integral to said sheet member, said pad bulges being resiliently compressible, wherein at least one of said pad bulges is substantially thicker than the remaining other of said pad bulges; and b) hinge means, hingedly interconnecting adjacent pairs of said pad bulges, said hinge means assisting in enabling said flexible sheet member to conformingly fit onto the inside crotch portion of the cyclist for dynamic comfort of the cyclist during pedalling.

13. A seat pad as in claim 12, wherein each of said pad bulges includes a core layer made of polyurethane, a first surface layer and a second surface layer opposite said first surface layer, both said first surface layer and second surface layer being made from polyester.

14. A seat pad as in claim 13, wherein said first surface layer is made from polyester felt, said polyester felt for engaging the thigh skin of the cyclist; and said second surface layer is made from brushed micro-fiber polyester;

and said pad bulges include a front pad bulge and said at least one of said pad bulges include a pair of rear pad bulges.

15. A seat pad as in claim 12, wherein said seat pad defines a front portion and a rear end portion, said front portion being narrower than said rear end portion, said front portion defining a generally semi-cylindrical shape in front end view, said rear end portion being slightly arcuate and coextensive with said generally semi-cylindrical shape of said front portion.

16. A flexible seat pad for fitting onto the inside crotch portion of a cyclist, said seat pad consisting of a generally convex unitary flexible sheet member, said sheet member defining:

a) a number of pad bulges, integral to said sheet member, said pad bulges being resiliently compressible; and b) hinge means, hingedly interconnecting adjacent pairs of said pad bulges, said hinge means assisting in enabling said flexible sheet member to conformingly fit onto the inside crotch portion of the cyclist for dynamic comfort of the cyclist during pedalling;

wherein said pad bulges include:

a) an intermediate pad bulge, having about 5 mm in thickness;

b) a front pad bulge, having about 5 mm in thickness;

c) a pair of rear pad bulges each having about 10 mm in thickness;

d) a first pair of lateral side pad bulges each having about 3 mm in thickness; and e) a second pair of lateral side pad bulges each having about 4 mm in thickness.

* * * * *

UNITED STATES PATENT AND TRADEMARK OFFICE

CERTIFICATE OF CORRECTION

PATENT NO. : 6,393,618 B2
DATED : May 28, 2002
INVENTOR(S) : Louis Garneau

It is certified that error appears in the above-identified patent and that said Letters Patent is hereby corrected as shown below:

Column 5,
Line 40, should read -- stitching lines, said sheet member defining --.

Signed and Sealed this

Second Day of September, 2003

JAMES E. ROGAN
*Director of the United States Patent and Trademark Office*